US005675303A

United States Patent [19]

Kelaita, Jr. et al.

[11] Patent Number: 5,675,303

[45] Date of Patent: Oct. 7, 1997

[54] MOLDED CASE CIRCUIT BREAKER ACCESSORIES

[75] Inventors: Joseph B. Kelaita, Jr., Bristol; Stephen R. St. John, Killingworth; Joseph M. Palmieri, Southington; J. Peter McCuin, Bristol, all of Conn.

[73] Assignee: General Electric Company, New York, N.Y.

[21] Appl. No.: 626,222

[22] Filed: Mar. 29, 1996

[51] Int. Cl.[6] ..... H01H 75/12

[52] U.S. Cl. ..... 335/35; 335/172

[58] Field of Search ..... 335/23–25, 35–38, 335/167–176

[56] References Cited

U.S. PATENT DOCUMENTS 3,742,402 6/1973 Nicol et al. ..... 335/17

3,973,230 8/1976 Ciarcia et al. .

4,209,761 6/1980 Klein et al. ..... 335/17

*Primary Examiner*—Lincoln Donovan

*Attorney, Agent, or Firm*—Richard A. Menelly; Carl B. Horton

[57] ABSTRACT

Molded case circuit breaker accessories using slightly modified circuit breaker cases are described. Several of the accessories utilize a microswitch to provide remote indication of an auxiliary function. One modification of the circuit breaker case includes upstanding posts to capture and position the microswitch while a further modification utilizes the magnetic trip unit adjustment screw and a support plate.

7 Claims, 4 Drawing Sheets

MOLDED CASE CIRCUIT BREAKER ACCESSORIES

BACKGROUND OF THE INVENTION

Circuit breaker accessories such as shunt trip, auxiliary switch, undervoltage release devices and the like are enclosed in a molded case circuit breaker enclosure. The accessory device is juxtaposed next to a standard circuit breaker having interruption facility and is arranged to receive an extension of the circuit breaker trip bar. A handle tie is used to join the operating handle of the accessory to the operating handle of the circuit breaker to move to the ON and OFF positions in unison.

US Pat. No. 3,973,230 entitled "Circuit Breaker Accessories Incorporating Improved Auxiliary Switch" describes the use of a lever joined to the trip bar and welded to a flexible contact arm to connect and disconnect with a shunt trip solenoid all contained within a standard molded case circuit breaker enclosure. The auxiliary switch accessory is used in a shunt trip solenoid energizing circuit or a trip alarm circuit.

The positioning and adjustment of the lever and contact arm after insertion and welding poses a problem both at the time of manufacture and later at the time of installation in the field. The tension on the lever may vary over long periods of operation and fail to respond in view of metal fatigue.

It would be economically advantageous to provide a simpler interconnection between the accessory unit operating handle, circuit breaker trip bar and the electrical accessory without the tolerance and fatigue problems. One purpose of the invention is to provide a simple, efficient accessory arrangement that performs long term operations in the field without failure due to tolerance variation or metal fatigue of the internal components.

SUMMARY OF THE INVENTION

A circuit breaker accessory case includes means for attaching a microswitch in positioned relationship with a circuit breaker trip bar and an accessory operating handle that is connected to the circuit breaker operating handle by means of a handle tie. An extension on the inner surface of the operating handle shank interacts with the microswitch button when the accessory is an auxiliary switch. An extension on the trip bar interacts with microswitch button when the accessory is a bell alarm or a shunt trip.

DESCRIPTION OF THE PREFERRED EMBODIMENT

Figure 1:
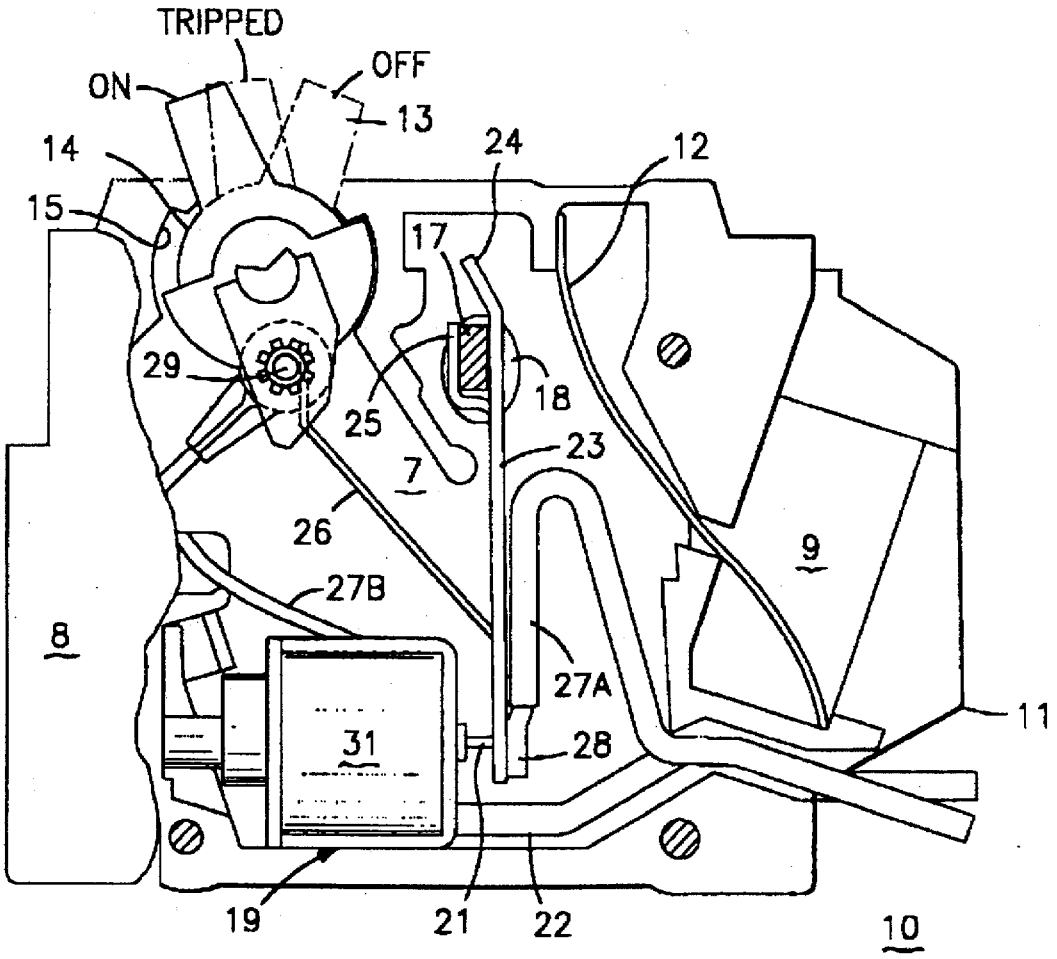
FIG. 1 (PRIOR ART)
FIG. 1 is a side view of a circuit breaker accessory of the prior art with the cover removed to depict the internal components.

A circuit breaker accessory 10 as described in the aforementioned U.S. Pat. No. 3,973,230 is shown in FIG. 1 to consist of a molded plastic case 11 and molded plastic cover 8 similar to a standard circuit breaker enclosure with a shield 12 inserted to block off the terminal compartment 9. The cover 8 is cut away to depict the internal operating components. A standard operating handle 13 extends from the top of the case and is connected to an associated circuit breaker by means of a handle tie so that the handles move in unison between the ON, OFF and TRIPPED positions. A common trip bar 17 extends within the case 11 by means of the opening 18 provided in the back wall 7 of the case 11. A lever 23 is attached to the trip bar by means of tabs as indicated at 24, 25 so that the lever rotates in response to the trip bar and visa versa. A flexible steel contact arm 26 is welded at one end to the end of the electrical conductor 27A and to the lever 23 as indicated at 28. A shunt trip unit 19 consisting of the electromagnet 31 and the plunger 21 motivates the lever 23 upon response to an electrical signal received over conductors 22 and 27A which rotates the trip bar 17 to articulate the operating mechanism in the associated circuit breaker to interrupt the associated electric circuit as described within the aforementioned US patent. The position of the handle is established by connection between the end of the flexible contact arm 26, the post 29 extending from the handle flange 14, and the conductor 27B that provides the second input to the electromagnet 31. The post moves to the positions indicated in phantom as the handle flange rotates within the circular hub 15 formed within the case 11. The end of the contact arm 26 moves away from the post 29 and breaks contact with the conductor 27B to prevent the electromagnet from being continuously supplied with electric current. When the accessory is to perform as a bell alarm to provide remote indication of the occurrence of a trip within the associated circuit breaker, the shunt trip unit 19 is omitted. The rotation of the trip bar 17 rotates the lever 23 and the contact arm 26 to electrically break the connection between the lever 23, post 29 and conductor 27B to provide indication over conductors 22 and 27A that such a tripping event has occurred.

Figure 2:
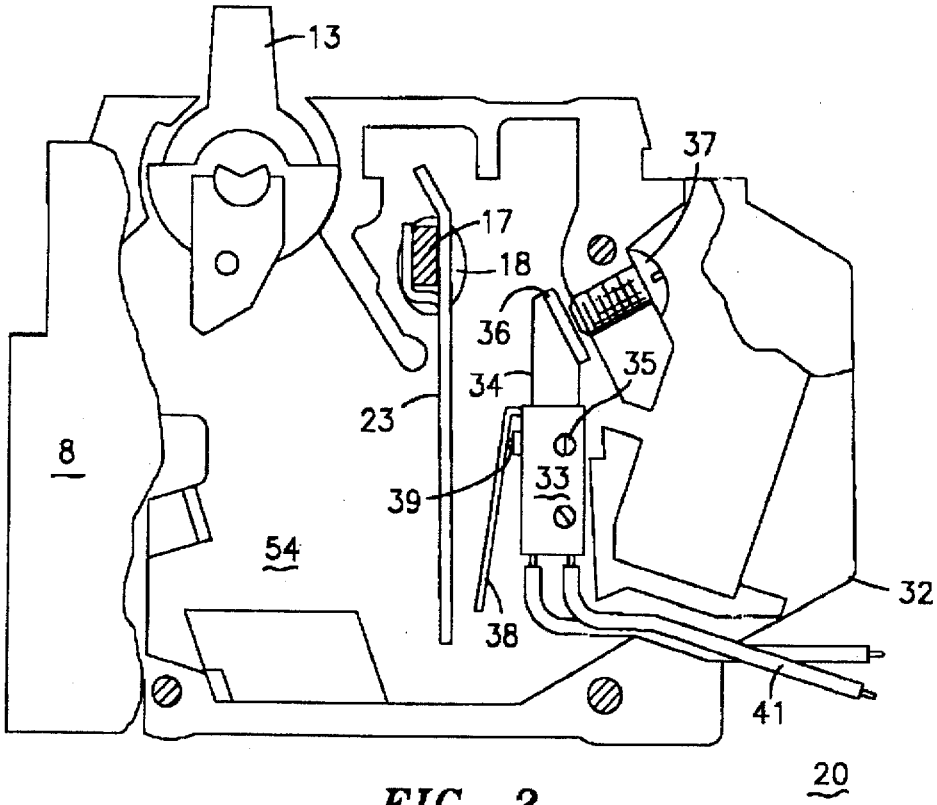
FIG. 2 is a side view of one embodiment of a circuit breaker bell alarm accessory according to the invention.

In accordance with the invention, a bell alarm accessory 20 is shown in FIG. 2 and consists of a case 32 similar to the case 11 of FIG. 1 with a similar operating handle 13, trip bar 17 and lever 23. The bell alarm accessory includes a microswitch 33 with a lever arm 38 that activates the button 39. "Microswitch" is a registered trademark of Honeywell Inc. for a miniature switch that includes a spring-loaded actuator button. The microswitch 33 is attached to the circuit breaker case 32 by means of a metal support plate 34 having a tab 36 upstanding at one end. The microswitch is secured to the plate by means of screws 35 and the plate is secured to the case by means of the screw 37. The screw 37 is similar to the calibration screw used within circuit breakers to calibrate the thermal magnetic trip unit contained there. The bell alarm accessory behaves in a manner to that described earlier with reference to FIG. 1 in that the rotation of the trip bar 17 rotates the attached lever 23 in response to a trip occurrence in the associated circuit breaker. The lever 23, in this arrangement, drives the switch arm 38 against the button 39 to provide remote indication thereof by means of the conductors 41.

Figure 3:
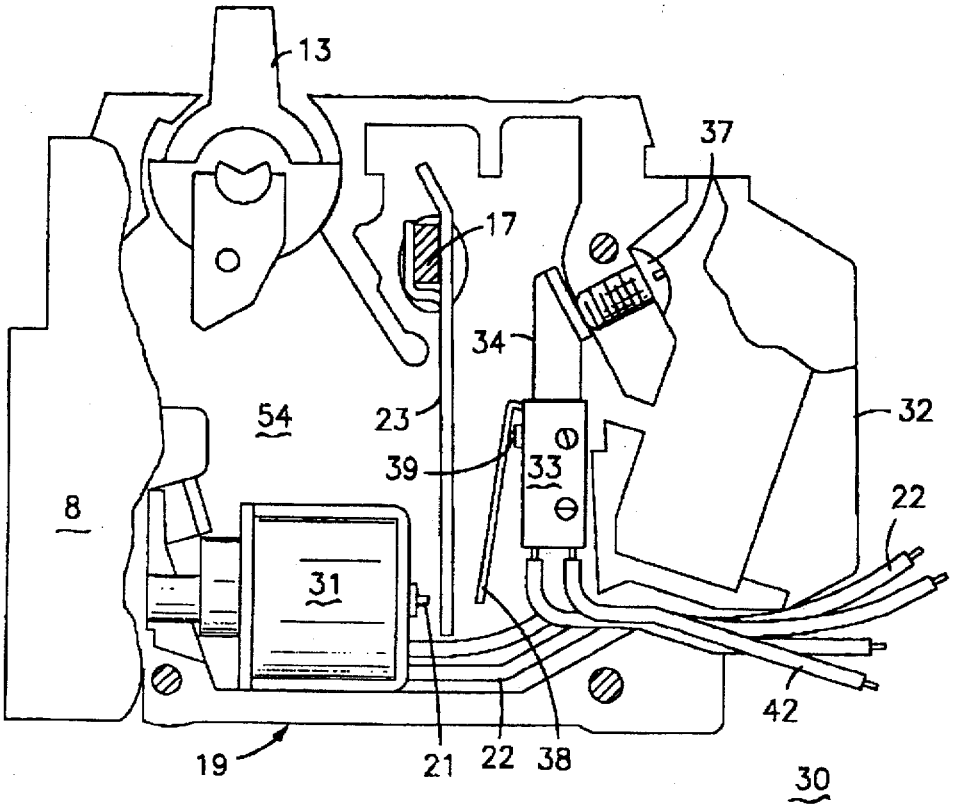
FIG. 3 is a side view of one embodiment of a circuit breaker shunt trip accessory according to the invention.

In further accordance with the teachings of the invention, a shunt trip accessory 30 is shown in FIG. 3 and consists of a case 32, operating handle 13, trip bar 17, lever 23, microswitch 33, lever arm 38, button 39, support plate 34 and attachment screw 37. The shunt trip unit 19 is similar to that described in FIG. 1 and contains an electromagnet 31 and plunger 21 along with similar conductors 22 to provide actuation of the electromagnet 31 to activate the plunger. The operation of the shunt trip accessory 30 is simpler than that of FIG. 1 since the lever 23 in this arrangement, in response to the urgence of the plunger 21, rotates the trip bar 17 to articulate the operating mechanism in the associated circuit breaker and drives the switch arm 38 against the button 39 to provide remote indication thereof by means of the conductors 42. Tolerance compensation between the active components lever 23 and switch arm 38 is automatically provided in view of the relative length of the switch arm and its flexibility.

Figure 4:
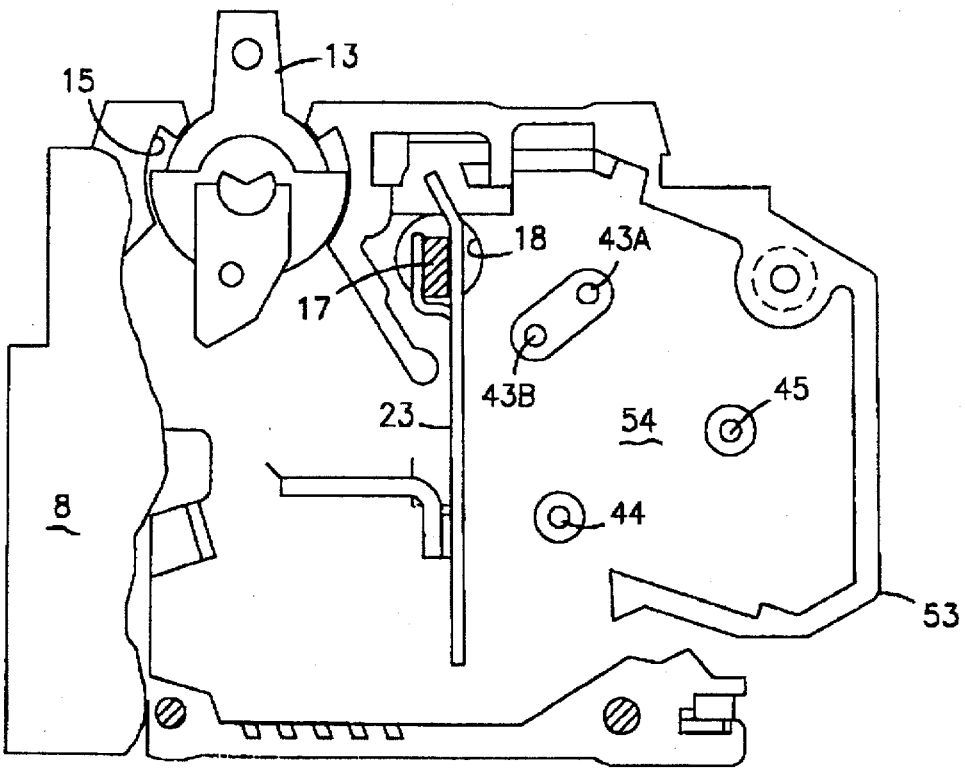
FIG. 4 is a side view of a further embodiment of a circuit breaker accessory case according to the invention with the cover removed to depict the internal structure.

An accessory case 40 for automated assembly of the accessory components is best seen by now referring to FIG. 4. A unitary plastic modified case 53 is formed to include the circular recess 15 to support the operating handle 13 and the aperture 18 which accepts the circuit breaker trip bar 17. Upstanding posts 43A, 43B, 44 and 45 are integrally-formed within the back wall 54 of the modified case 53 for providing automated assembly to the microswitch 33 as will be described below in reference to FIGS. 5–7. A lever 23 can be attached to the trip bar 17 in the manner described earlier to complete the accessory case 40 when a shunt trip or bell alarm accessory function is required.

Figure 5:
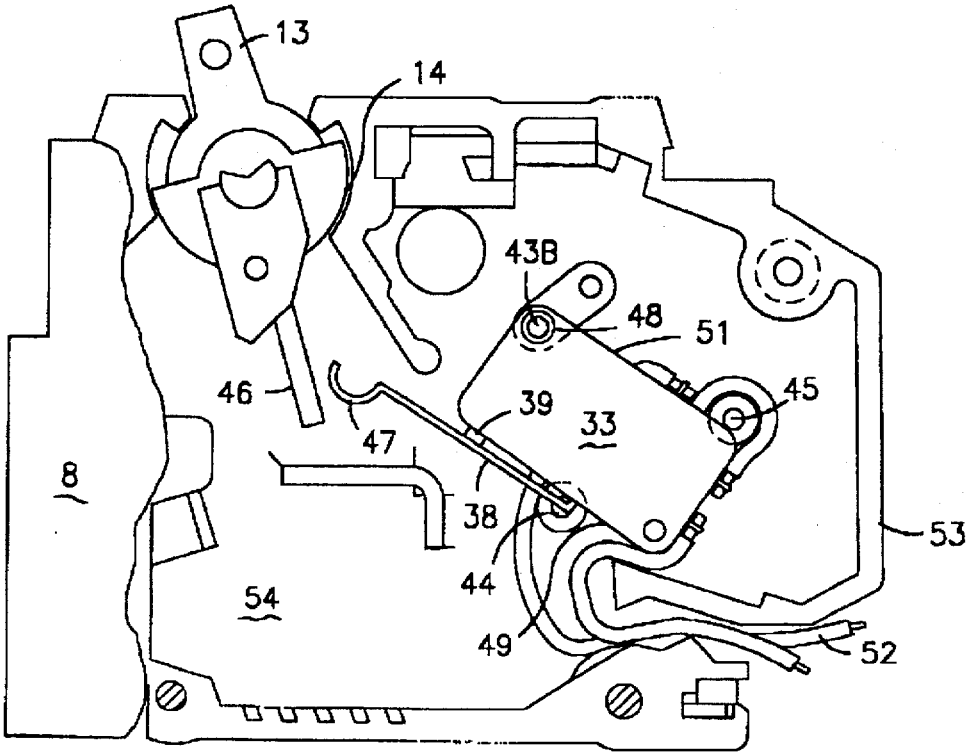
FIG. 5 is a side view of a further embodiment of a circuit breaker shunt trip accessory according to the invention.

An auxiliary switch accessory 50, shown in FIG. 5, utilizes the integral shaped modified case 53 to support an operating handle to which a pin 46 has been attached to the bottom of the handle flange 14. A microswitch 33 is assembled to the modified case by capturing the upstanding post 43B within the aperture 48 of the microswitch and positioning the sides 49, 51 of the microswitch against the corresponding upstanding posts 38, 45. The arm 38 is positioned automatically such that the radius 47 at the end of the arm interacts with the pin 46 extending from the handle flange 14 so that when the handle 13 is connected via a handle tie to the juxtaposed circuit breaker handle (not shown) operation of the circuit breaker handle between ON and OFF positions moves the opposite end of the arm in and out of contact with the button 39 to provide remote indication thereof over conductors 52.

Figure 6:
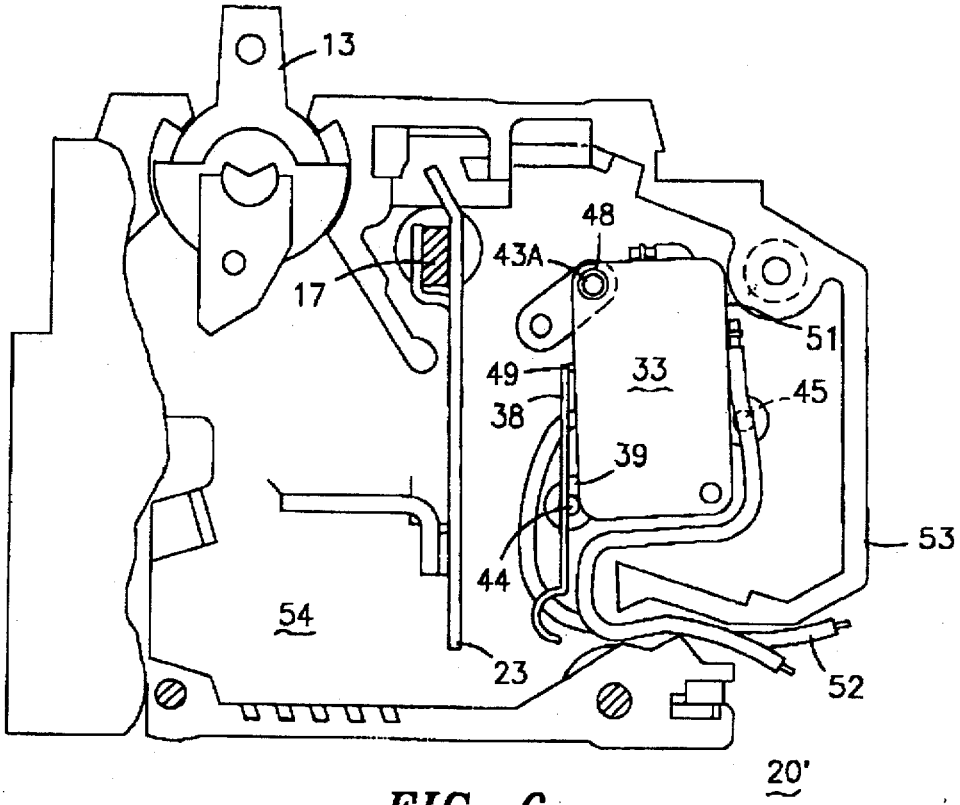
FIG. 6 is a side view of a further embodiment of a circuit breaker bell alarm accessory according to the invention.

FIG. 6 depicts a bell alarm accessory 20' having an extending operating handle 13 similar to that of FIG. 2 with a lever 23 similarly arranged next to the trip bar 17 to drive the arm 38 in and out of contact with the button 39 on the microswitch 33. In place of the support plate 34 in FIG. 2, the microswitch 33 is positioned by means of post 43A within the aperture 48 and posts 44, 45 against the sides 49, 51 within the unitary plastic modified case 53 in the manner described earlier in reference to FIG. 5. Indication of the operation of the trip bar 17 is provided to a remote alarm over conductors 52.

Figure 7:
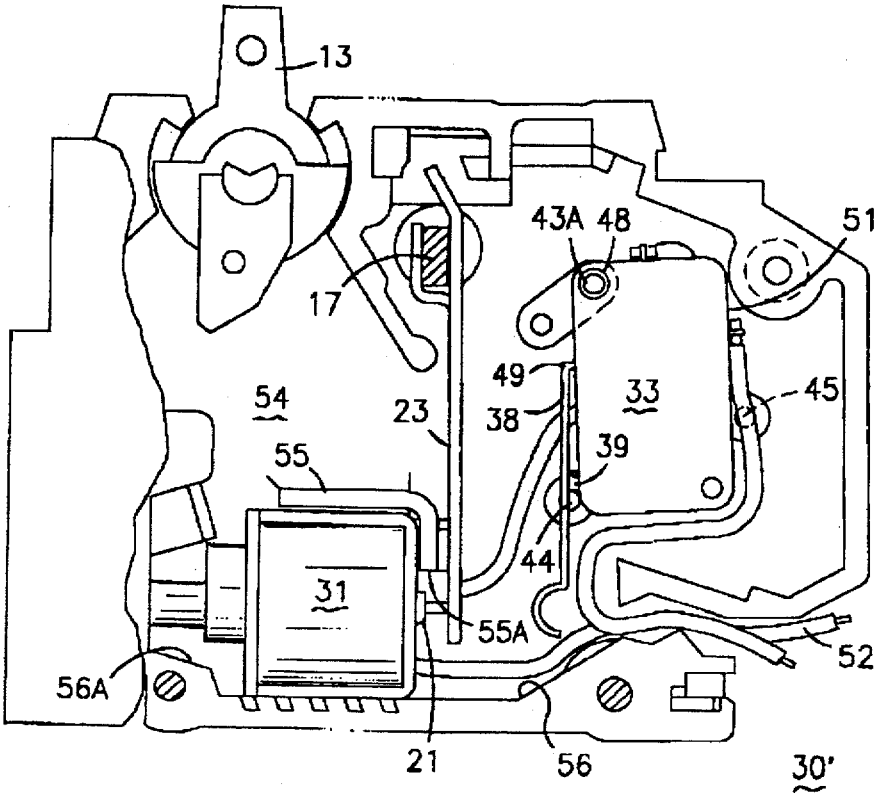
FIG. 7 is a side view of a further embodiment of a circuit breaker shunt trip accessory according to the invention.

FIG. 7 depicts a shunt trip accessory 30' similar to that of FIG. 3 without employing the support plate 34 to support the microswitch 33. The operating handle 13, electromagnet 31, plunger 21 interact with the lever 23 and trip bar 17 to rotate the trip bar and drive the lever 23 against the arm 38 and button 39 to provide remote indication thereof over conductors 52 in a similar manner. The microswitch is positioned within the unitary plastic modified case 53 in the manner described earlier in reference to FIG. 5. Post 43A extends within the aperture 48 and the sides 49, 51 are captured against the corresponding posts 44, 45 to provide automatic alignment of the components as well as to maintain tolerance between the components over long periods of continuous operation thereof.

Comparing the auxiliary switch accessory 50 of FIG. 5, bell alarm accessory 20' of FIG. 6 and shunt trip accessory 30' of FIG. 7 to the unitary plastic modified case 53 that comprises the accessory case 40 of FIG. 4, it is seen that the arrangement of the microswitch 33 relative to the upstanding posts 43A, 43B, 44, 45 automatically sets the form, fit and function of the components without requiring additional structure. The posts automatically set the location of the internal components and the cover 8 tightly holds the components against the backwall 54 to prevent movement in the event the accessories are used within a rough mechanical operation.

Various circuit breaker accessories have herein been described that contain fewer components than earlier devices as well as being adaptable to automate robotic assembly. The provision of the L-shaped rib 55 and extension 55A upstanding from and integrally-formed with the back wall 54 sets the location of the electromagnet 31 against the protrusion 56A on the bottom wall 56 to set the location of the electromagnet 31.

We claim:

1. A circuit breaker auxiliary switch accessory comprising:

a molded plastic case;

means at a top part thereof for supporting an operating handle;

aperture means within a backwall of said case for receiving a circuit breaker trip bar;

a lever extending from said trip bar arranged for moving in unison with said trip bar;

a plurality of support posts integrally-formed within said case and arranged at predetermined locations therein; and a microswitch having an aperture extending therethrough, one of said support posts being captured within said aperture for positioning said microswitch adjacent said lever whereby movement of said operating handle provides remote indication over conductors connecting with said microswitch.

2. A circuit breaker bell alarm accessory comprising:

a molded plastic case;

means at a top part thereof for supporting an operating handle;

aperture means within a backwall of said case for receiving a circuit breaker trip bar;

a lever extending from said trip bar arranged for moving in unison with said trip bar;

a plurality of support posts integrally-formed within said case and arranged at predetermined locations therein within said case; and a microswitch having an aperture extending therethrough, one of said support posts being captured within said aperture for positioning said microswitch adjacent said lever.

3. A circuit breaker bell alarm accessory comprising:

a molded plastic case;

means at a top part thereof for supporting an operating handle;

aperture means within a backwall of said case for receiving a circuit breaker trip bar;

a lever extending from said trip bar arranged for moving in unison with said trip bar;

a support plate arranged within said case; and a microswitch attached to said support plate and positioned adjacent said lever for providing remote indication of the position of said trip bar.

4. A circuit breaker bell alarm accessory comprising:

a molded plastic case;

means at a top part thereof for supporting an operating handle;

aperture means within a backwall of said case for receiving a circuit breaker trip bar;

a lever extending from said trip bar arranged for moving in unison with said trip bar;

a plurality of support posts integrally-formed within said case and arranged at predetermined locations therein within said case; and a microswitch in intermediate abutment with said support posts for positioning said microswitch adjacent said lever for providing remote indication of the position of said trip bar.

5. A circuit breaker shunt trip accessory comprising:

a molded plastic case;

means at a top part thereof for supporting an operating handle;

aperture means within a backwall of said case for receiving a circuit breaker trip bar;

a lever extending from said trip bar arranged for moving in unison with said trip bar;

a support plate arranged within said case;

a microswitch attached to said support plate and positioned on one side of said lever; and an electromagnet positioned on an opposite side of said lever, whereby said electromagnet releases a plunger into contact with said lever to rotate said trip bar and actuate said microswitch for providing remote indication of the rotation of said trip bar.

6. A circuit breaker shunt trip accessory comprising:

a molded plastic case;

means at a top part thereof for supporting an operating handle;

aperture means within a backwall of said case for receiving a circuit breaker trip bar;

a lever extending from said trip bar arranged for moving in unison with said trip bar;

a plurality of support posts integrally-formed within said case and arranged at predetermined locations therein within said case;

a microswitch having an aperture extending therethrough, one of said support posts being captured within said aperture for positioning said microswitch on one side of said lever; and an electromagnet positioned on an opposite side of said lever, whereby said electromagnet releases a plunger into contact with said lever to rotate said trip bar and actuate said microswitch for providing remote indication of the rotation of said trip bar.

7. A circuit breaker shunt trip accessory comprising:

a molded plastic case;

means at a top part thereof for supporting an operating handle;

aperture means within a backwall of said case for receiving a circuit breaker trip bar;

a lever extending from said trip bar arranged for moving in unison with said trip bar;

a plurality of support posts integrally-formed within said case and arranged at predetermined locations therein within said case; and a microswitch in intermediate abutment with said support posts for positioning said microswitch adjacent said lever for providing remote indication of the position of said trip bar.

* * * * *